US007793398B2

(12) United States Patent
Dumortier et al.

(10) Patent No.: US 7,793,398 B2
(45) Date of Patent: Sep. 14, 2010

(54) METHOD OF REMOVING AIRCRAFT MASTIC

(75) Inventors: Laurent Dumortier, Targon (FR); Jacques Samenayre, Bordeaux (FR); Olivier Mantaux, Villenave d'Ornon (FR); David Lavigne, Casteljaloux (FR)

(73) Assignee: Aerowing, Nashville, TN (US)

( * ) Notice: Subject to any disclaimer, the term of this patent is extended or adjusted under 35 U.S.C. 154(b) by 0 days.

(21) Appl. No.: 12/463,516

(22) Filed: May 11, 2009

(65) Prior Publication Data

US 2009/0217501 A1 Sep. 3, 2009

Related U.S. Application Data

(62) Division of application No. 10/681,101, filed on Oct. 9, 2003, now abandoned.

(30) Foreign Application Priority Data

Oct. 9, 2002 (FR) ..... 02 12545

(51) Int. Cl.
*B23P 6/00* (2006.01)
*B23P 19/033* (2006.01)
*B23D 79/02* (2006.01)

(52) U.S. Cl. ..... 29/402.01; 29/402.02; 29/402.03; 29/402.06; 29/402.11; 29/426.4; 29/426.5; 15/93.1; 15/236.01; 30/169

(58) Field of Classification Search ..... 29/402.01, 29/402.02, 402.03, 402.06, 402.11, 402.19, 29/426.4, 426.5; 156/344; 15/96.1, 93.4, 15/235.01, 236.1, 236.01; 30/169
See application file for complete search history.

(56) References Cited

U.S. PATENT DOCUMENTS

| | | | | |
|---|---|---|---|---|
| 2,195,344 | A * | 3/1940 | Slaugenhop | 15/246.5 |
| 3,147,548 | A * | 9/1964 | Aspeek | 30/169 |
| 3,848,289 | A | 11/1974 | Bachmann | |
| 4,137,588 | A | 2/1979 | Sandt et al. | |
| 4,466,851 | A | 8/1984 | Hoffman | |
| 4,858,264 | A | 8/1989 | Reinhart | |
| 4,864,727 | A | 9/1989 | Chu | |
| 4,967,437 | A | 11/1990 | Morse | |
| 5,287,582 | A | 2/1994 | Kawai et al. | |
| 5,314,512 | A | 5/1994 | Sexton | |
| 5,353,465 | A | 10/1994 | Pierce et al. | |
| 5,924,204 | A | 7/1999 | Lane | |

FOREIGN PATENT DOCUMENTS

| | | |
|---|---|---|
| DE | 19949071 A1 | 4/2001 |
| GB | 2261901 A | 6/1993 |
| JP | 5321189 | 12/1993 |

* cited by examiner

*Primary Examiner*—Jermie E Cozart
(74) *Attorney, Agent, or Firm*—Waddey & Patterson, P.C.; Lucian Wayne Beavers

(57) ABSTRACT

A method of removing aircraft mastic includes contacting a cutting head with a body of aircraft mastic within a fuel tank of an aircraft, and vibrating the cutting head with a pneumatic vibrator to cut away the mastic without scratching the metal components to which the mastic is adhered.

19 Claims, 2 Drawing Sheets

METHOD OF REMOVING AIRCRAFT MASTIC

This application is a divisional of and claims priority based upon U.S. patent application Ser. No. 10/681,101 by Dumortier et al. for "Device For Removing Mastic, Particularly For The Repair Of Joints In Structures Of Aircraft Tanks And Container For Use Therewith", filed on Oct. 9, 2003 now abandoned, which claims foreign priority based upon French Appl. No. 02 12545 filed Oct. 9, 2002.

The present invention relates to a device for removing mastic, particularly for the repair of joints in the structures of aircraft reservoirs.

The invention also covers the container for use therewith.

Tanks, particularly in aircraft, are directly constituted by free volumes in the wings.

Thus, the wings are made from a structure comprised of ribs, stiffeners, with passages for the different members but the structure is essentially empty. Plates are then connected to this structure so as to provide a closed volume, with suitable shapes and having the mechanical characteristics necessary for flight.

The volume is thus mechanically closed but it is not sealed because the plates are screwed or riveted and if the physical continuity is ensured, the joints between the plates are not hermetic.

If it is desired to use these volumes thus provided to constitute tanks for fluids and particularly for fuel, it is necessary to seal the joints at all the passages for securement means such as aeronautical screws and rivets.

This sealing is achieved by a deposition of strips of mastic on all the joints and plugs of mastic on all the through passages, enclosing the securement means.

This mastic is deposited by means of a gun in more or less viscous form and then polymerized in situ at ambient temperature with a suitable hygrometry.

In the case of a too low temperature or to accelerate the operation, it is possible to use a thermo-reactor particularly sold under the name "SUNAERO" so as to emit infrared radiation in the region of absorption of the types of mastic used. The polymerization is thus accelerated.

This deposition of mastic is necessarily carried out once the wing is completed. However, given the number of reinforcing elements, the through stiffeners and the other equipment, and given the dimensions of the wings, particularly in thickness, it will be seen that there remains little room to permit an operator to move and even less to work.

It is thus necessary to have access to all the points of passage of the securement means and all the joints, exhaustively and certain ones are very difficult of access. For the deposition of a strip with the help of a gun, if the operation is delicate, it requires only a reasonable physical effort, the difficulty resulting more from the uncomfortable position of the operator and the necessary precision.

These mastics used are suitable to resist the fuel of course, and are very sophisticated because they resist wide temperature ranges, having certain qualities of hardness whilst sufficient flexibility to avoid breaking during movements and vibrations to which the different pieces are subject.

The power of adherence is in all cases very important to avoid any risk of unsticking. Very rigorous procedures must be used given that the mastic adheres not on the metal but on the layers of paint that cover and protect, with which the different pieces are covered.

It is unavoidable that defects will be present and that in the course of time, fissures will appear and give rise to loss of fuel.

This problem is often present in the places that are the most stressed such as the roots of the wings or in line with the support structure of the propulsion means.

Workers overcome these defects during systematic inspection or maintenance or during specific operations, if necessary.

During this step of repair, it is necessary first to empty the volume of the wing in question, to evacuate the fumes and then to locate the leak. The access to the interior volume takes place through a manhole provided in the wing from which the door is removed during precise procedures.

To ensure repair, it is necessary to remove the used mastic in the region in question and to replace it with new mastic.

It is there that serious problems arise, which the present invention proposes to solve in an ideal way.

Thus, the mastic is even in its composition provided with a very high power of adherence, which power increases with time. Moreover, the hardness of the mastic increases with age.

As has been explained, the conditions of access to certain regions are difficult and to remove the mastic, it is then necessary to expend substantial energy.

Fortunately, the processes of detection of leaks with precise location of a leak permit circumscribing the zone and limiting the size of the repair of the seal.

The solution at present consists in a process for mechanically scraping with spatulas of polycarbonate for example, which are sharpened and manipulated by the operators so as best to scrape the regions in question. This operation is thus manual. Electrical apparatus, which might generate sparks, is prohibited because even after ventilation, the atmosphere can remain locally explosive.

It is also necessary to specify that only chips are permitted, so as to be able to recover them and withdraw them from the body of the wing, contrary to sawing mastic which could generate dust. The residual dust or powder could then plug the kerosene filters and thus are prohibited.

Similarly, solutions have been experimentally tried with chemical solutions. The products used must be neutral for the operator but also for the constituent materials of the wing. Moreover, after having used them, it will be seen that at best there is achieved a softening of the mastic, which again must be mechanically removed.

As to this cleaning with chemical solutions, it remains delicate because it is impossible to determine when the product ceases to act, which disturbs the filling of the tanks.

Ultrasound, as well as jets of water, require an apparatus that is too large and it is necessary to provide simultaneous recovery systems for the waste because projections necessarily result. Moreover, the penetration of water into the joints of the structure can generate points of corrosion that are difficult to detect.

Tests have been conducted with cryogenic products so as to render the mastics breakable with the hope of facilitating the manual operation. But there are problems of hygienics and safety for the operators. The effectiveness of such a method is very limited.

Another constraint is due to the fact that the surfaces carry a coating, generally a protective primer, which must be left on the metal. In addition to this delicate coating, it is absolutely necessary to avoid any scratching of the metal which would constitute a potential starting point for rupture. As the material is generally an aluminum alloy, scratches can be unfortunately easily produced.

The region must be perfectly cleaned to pursue the procedure of renewing the mastic and obtaining a good sealing after deposition of a new strip or plug of mastic to be polymerized.

The duration of this phase represents substantially half the time necessary for the complete operation.

The constraints associated with the working conditions for the operators, require finding a more comfortable solution for the operators and more effective for the users. Such a solution has been sought by users for many years.

The operation by the workers is long and the downtime of an aircraft is extremely costly. When repairs are made in downtime for maintenance, this is less of a problem even though costly but when it is a question of immediate operation at a poorly equipped airport, under emergency conditions, far from home, the financial loss can be very high.

The present invention overcomes the preceding drawbacks and the corresponding container permits rapid operations in any place, with a quality of operation compatible with the needs and the aeronautical standards.

The present invention will now be described with respect to the accompanying drawings which show a preferred but non-limiting example of the device of the present invention, the different figures showing:

DETAILED DESCRIPTION OF THE INVENTION

Figure 1:
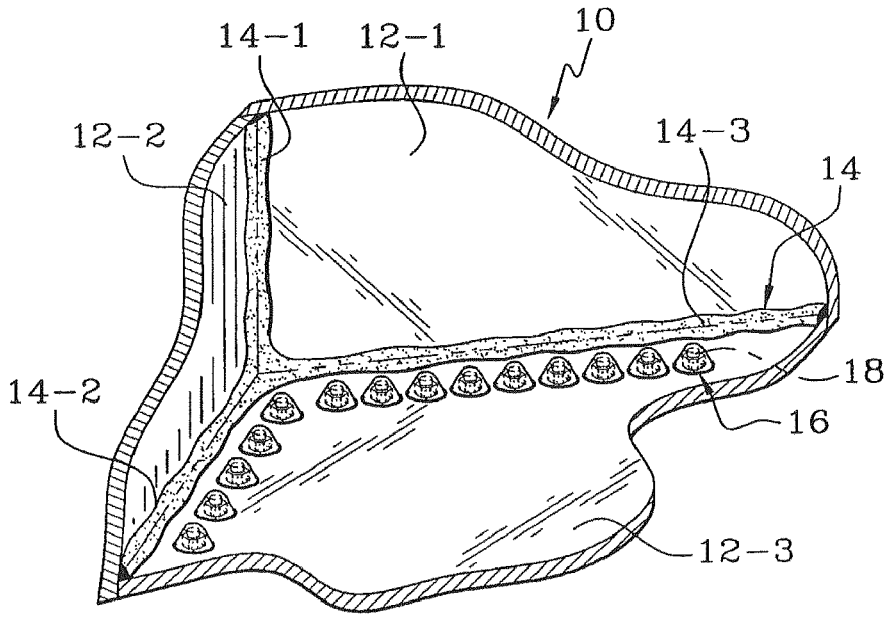
FIG. 1, a view of a portion of an aircraft wing with joints and securement wings covered with mastic, FIG. 2A, a detailed view of an aeronautical screw, in perspective, FIG. 2B, a cross-sectional view of the screw of FIG. 2A, FIG. 3A, a view of the device according to the invention, FIG. 3B, an enlarged view of a tip, FIG. 3C, a detailed view of a modified tip, and FIG. 4, a view of the operating container.

In FIG. 1, there is shown a portion 10 of the wing of an aircraft with a compound region comprising a joint with three plates 12-1, 12-2 and 12-3 forming an angle, the three strips 14-1, 14-2 and 14-3 of mastic 14 meeting at the intersection.

This schematic representation also shows a series of means 16 for securing plates, in this instance aeronautical screws 18.

Figure 2A:
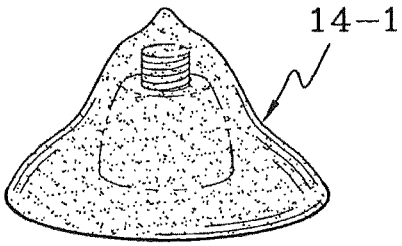
Figure 2B:
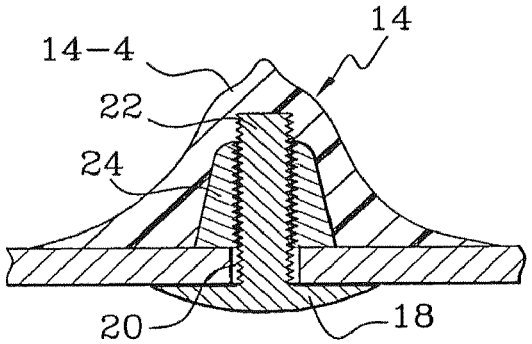

These screws, as will be seen from FIGS. 2A and 2B, pass through holes 20 which it is necessary to seal.

Because of this, the solution consists in a deposition of mastic 14, in the form of a plug 14-4 covering the assembly of the screw 22 and its nut 24. It will be noted that this plug is prolonged beyond the nut so as to adhere to the surface itself of the plate.

These deposits of mastic 14 mate perfectly with the surfaces on which they are deposited, which renders the removal the more complicated.

It is to be remembered that aluminum and its alloys are excellent aeronautical materials, but corrode under the action of oxygen in the presence of an acid medium, of water, of chlorine, which requires the covering of the assembly of the structure with a prime coating which it is necessary to preserve during the operations of mastic removal.

As to scratches, it is necessary to avoid them because aluminum and its alloys have a particular behavior. A scratch is thus a starting point for rupture: the corrosion concentrates at this precise point and develops in line with this small point. This concentration of the corrosive action is a danger.

One of the great problems is thus the choice of the mastic removal tool, because it is necessary also to find a material which resists as much as possible the wear, not for reasons of economy, but for reasons of production because it is not possible for the operator constantly to change tools or to have the quality of this tool decline in the course of work, the duration of the operation then being proportionally increased.

As to untimely removal of the primer, this has to be repaired by depositing a new coating on the degraded zone; but in this case, the duration of the operation is increased, which is not desirable.

The present invention relates to a device comprising means 26 for alternating vibratory movement and a tool 28 secured to these means.

The means 26 for causing vibratory alternating movement comprises a body 30 including a motor 32 and a mandrel 34 adapted to receive said tool 28.

Preferably, the motor is of the pneumatic type and the connection is a rapid connection of the type of those sold under the name "STAUBLI". The frequency of vibration is about 120 Hz, to give an order of magnitude.

The tool 28 comprises in this embodiment a shaft 36 and a head 38.

The shaft is adapted to be mounted in the mandrel 34 whilst the head 38 is the contact member with the mastic and the surface of the wing, provided to travel along the interface.

This head must be made of a material whose hardness is sufficient to cut off chips of mastic and resist wear, but not too hard so as to give rise to scratches under the effect of vibratory alternating movement.

These two parameters are antithetical, which is why it will be understood that until the present such a device has not been used because those skilled in the art are dissuaded from having resource to such means.

Numerous tests have been carried out and there result certain well adapted particular materials. It was then necessary to determine the production of these tools, which permits an orientation toward the final choice for such or such a user.

Among the materials giving the best results, are polyetheretherketones (PEEK), polyoxymethylenes, polyetherimides or epoxy resins.

As to production, the preference is given to polyetheretherketones loaded with carbon or glass fibers.

When the load is carbon, although the quantities are very small, the use in aircraft is questionable because the carbon creates corrosion in contact with aluminum and its alloys.

The preference thus is rather for polyetheretherketones, loaded with 30% glass fibers.

As to these materials, it is necessary also to analyze the shape of the working region of the head.

The simple shape and the most used is beveled, particularly with a vibratory alternating movement along the working axis.

Cutting angles of this bevel have been analyzed at 30.degree., 45.degree. and 60.degree., symmetrical and asymmetrical.

The symmetrical or asymmetrical angle of 30.degree. is generally satisfactory with very little dust, by producing chips of good quality, without giving rise to rebound prejudicial to the users because of the alternating vibratory movements.

Figure 3A:
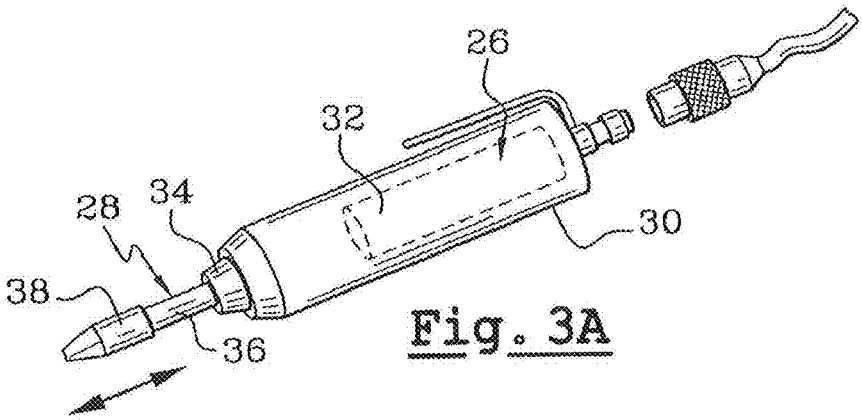
Figure 3B:
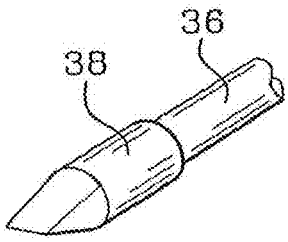

This is the form shown in FIG. 3B.

Figure 3C:
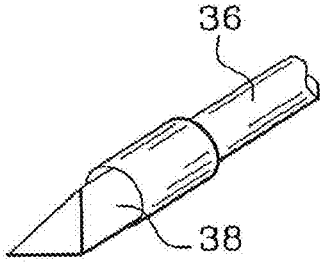
Figure 4:
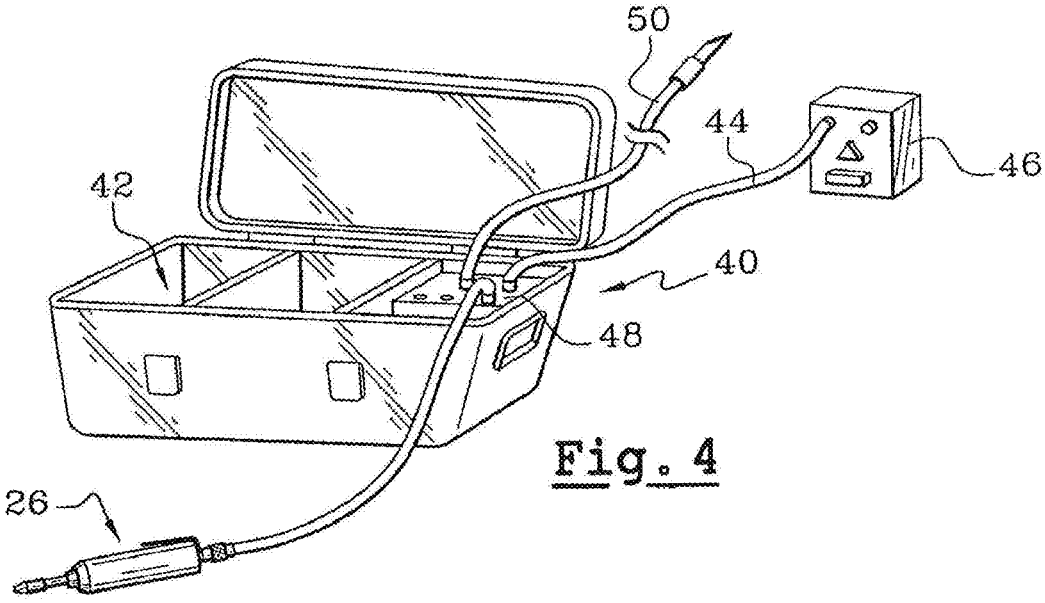

FIG. 3C shows a so-called special head because it should be used particularly for certain angles that are still more difficult of access. The shapes are thus determined by the applications.

Practical tests have shown that the operator does not need to exert a strong force on the device, a pressure of several bars being sufficient to hold the tool in abutment against the mastic, the vibrating oscillatory movement ensuring the dislodging of the mastic or the formation of chips.

In any case there is provided a valve for adjusting the pneumatic pressure when this is the source of power, so as to obtain adequate pressure at the end of the tool.

It is to be noted that the pneumatic choice is preferable, because the risks of leakage do not have the consequences that would arise in the case of a hydraulic fluid.

Moreover, the hydraulic way requires a specific source whilst compressed air is available at all workplaces, even the poorest equipped.

An electric motor is prohibited because of the conductive metallic environment and the possible explosive atmosphere.

The invention also provides a container 40 for use therewith, adapted to provide the entire support for mastic removal.

Such a container 40 comprises at least one device according to the present invention with a supply 42 of tools considered to be consumable, suitable flexible tubing, such as a tubing 44 for connection to a local source 46 for compressed air when it is not provided, a housing 48 for regulation of the delivered air pressure, a suction system 50 with a venturi connected to the same source of compressed air supply.

This container can also comprise individual protections such as goggles, gloves, masks and ear protectors.

Thus, during an operation, the operator goes to the parked plane with this container. He needs only a source of compressed air to connect his devices.

After the operations of preparation for use of tanks, such as emptying, devaporizing, opening a manhole, detection of the leak, operations which can moreover be conducted prior to his arrival, it is necessary for him to have access to the manhole corresponding to the region in question.

He carries with him, into the wing, the complete device connected to the source of compressed air after having adjusted the pressure, the suction tubing 50 and if desired several replacement tools 28.

To give an order of magnitude, the lifetime of a tool is estimated to be about half an hour.

The operator actuates the control lever while applying with medium force the head against the plug or the strip of mastic to be removed, thereby generating chips.

After having carried out a portion or all of the work, the suction of these chips permits keeping the region clean.

The working conditions for the operator are greatly improved and the rapidity of execution is not to be compared with the manual operation of mastic removal.

Even if the region is very difficult to reach, the operator having no great force to supply, can reach it and exert a sufficient pressure on the device to obtain the desired result.

Moreover, the working time is much shorter because the frequency of vibration permits the operator to generate chips as with a wood chisel.

The head comes into contact with the primer and withdraws the mastic without degrading this primer because of the nature of the material, the angle of the head, the frequency and the power of the vibrations. The thickness of mastic makes very little difference because the power of the tool permits cutting up the mastic bodily if necessary, including in the case of mastic that is aged. The operator thus carries out a reduced number of passes.

At the end of withdrawal of the mastic from the zone in question, it is to be given new mastic, which is not an operation that involves the present invention but which is indicated by way of information.

This step consists in a simplified manner of ensuring cleaning of the zone in question with a solvent to have a perfectly clean surface.

The strip or the plugs of mastic are produced with a deposition cone. This deposition is followed by accelerated polymerization of this mastic by means of heating with infrared radiation.

The sealing having been carried out, it is possible to repeat a leak test particularly by means of helium test equipment described in French patent application No. 02 07554 in the name of the same applicant, before again filling the tank.

There exist commercial tools permitting generating vibratory alternating movements but they are relatively heavy.

There can be developed a specific tool with a body of lightweight material without this tool being too light, because it is nevertheless necessary to have a certain inertia to ensure anti-recoil and the efficacy of each vibration, limiting also the work of the operator.

As a supplement to the device according to the present invention, it may be useful to provide an array of finishing brushes, particularly rotating, having fibers with characteristics analogous to those of the heads. In this case, the dust generated remains very limited because it is a matter of finishing and the suction means permit simultaneous suction.

What is claimed is:

1. A method of removing aircraft mastic, comprising:

(a) contacting a cutting head with a deposit of aircraft mastic within a fuel tank of an aircraft, the fuel tank constructed of metal components to which the deposit of mastic is adhered, the cutting head being made of a material selected from the group consisting of polyetheretherketones, polyoxymethylenes, polyetherimides and epoxy resins;

(b) vibrating the cutting head in contact with the deposit of aircraft mastic with a pneumatic vibrator and thereby cutting away the mastic; and (c) during step (b), avoiding scratching the metal components to which the mastic is adhered.

2. The method of claim 1, wherein in step (a) the cutting head material comprises polyetheretherketone.

3. The method of claim 2, wherein the cutting head material further comprises glass fibers.

4. The method of claim 3, wherein the glass fibers are present in the cutting head in a concentration of about 30%.

5. The method of claim 1, wherein:

in step (a) at least one of the metal components is a painted metal component; and step (b) is performed without removing the paint from the painted metal component.

6. The method of claim 5, wherein:

in step (a) the painted metal component comprises an aluminum alloy.

7. The method of claim 1, wherein in step (b) the mastic is cut away in chips.

8. The method of claim 1, wherein in step (b) the cutting head is vibrated at about 120 Hz.

9. The method of claim 1, wherein in step (a) the mastic comprises polymerized aircraft fuel resistant mastic.

10. The method of claim 1, wherein:

in step (a) the metal components include two aluminum alloy plates joined together at a joint, and the body of mastic includes a strip of mastic sealing the joint; and step (b) further comprises cutting the strip of mastic away from the joint.

11. The method of claim 1, wherein:

in step (a) the metal components comprise a plate and an aeronautical screw secured by a nut within a hole of the plate, the deposit of mastic prolonged beyond the nut to adhere to a surface of the plate; and step (b) further comprises cutting the deposit of mastic away from the nut.

12. The method of claim 1, further comprising:

prior to step (a), carrying a vibratory mastic removal tool including the pneumatic vibrator and the cutting head into an interior of an aircraft wing via a manhole opening within the wing.

13. A method of removing aircraft mastic, comprising:

(a) placing a mastic removal tool within an interior of an aircraft wing, the tool including a vibrator and a cutting head, the aircraft wing including metal plates joined together at an intersection with a strip of aircraft mastic sealing the intersection, wherein the cutting head comprises a material selected from the group consisting of polyetheretherketones, polyoxymethylenes, polyetherimides and epoxy resins;

(b) contacting the strip of mastic with the cutting head and pressing the cutting head against the mastic;

(c) vibrating the cutting head in a vibrating oscillatory movement with the vibrator; and (d) cutting chips of mastic from the strip of mastic with the vibrating cutting head without scratching the metal plates.

14. The method of claim 13, wherein:

in step (a) the cutting head comprises a polyetheretherketone loaded with carbon or glass fibers.

15. The method of claim 13, wherein:

in step (a) the cutting head comprises a polyetheretherketone loaded with about 30% glass fibers.

16. The method of claim 13, wherein:

in step (a) the aircraft wing further includes an aeronautical screw secured by a nut in a hole of one of the plates with a plug of aircraft mastic prolonged beyond the nut to adhere to a surface of the one plate; and step (b) further comprises cutting the plug of mastic away from the nut and the plate without scratching the plate.

17. The method of claim 13, wherein:

in step (a) the metal plates comprise an aluminum alloy material.

18. The method of claim 13, wherein:

step (c) further comprises vibrating the cutting head at an order of magnitude of about 120 Hz.

19. A method of removing aircraft mastic, comprising:

(a) placing a mastic removal tool through a manhole into an interior of an aircraft wing, the tool including a pneumatic vibrator and a cutting head, the cutting head comprising a material selected from the group consisting of polyetheretherketones, polyoxymethylenes, polyetherimides and epoxy resins, the aircraft wing including metal plates joined together at an intersection with a strip of mastic sealing the intersection, the metal plates comprising an aluminum alloy painted with a protective primer, the strip of mastic being bonded to the primer;

(b) contacting the strip of mastic with the cutting head and pressing the cutting head against the strip of mastic;

(c) vibrating the cutting head in a vibrating oscillatory movement with the vibrator; and (d) cutting the strip of mastic away from the plates with the vibrating cutting head without removing the primer under the strip of mastic and without scratching the aluminum alloy plates.

* * * * *